United States Patent [19]

Cumings

[11] 4,389,141

[45] Jun. 21, 1983

[54] MARINE STRUCTURE HAVING A DECK OR WORK PLATFORM SUPPORTED BY ABSORBING MECHANISMS

[75] Inventor: Norman E. Cumings, Parker, Colo.

[73] Assignee: Mobil Oil Corporation, New York, N.Y.

[21] Appl. No.: 221,716

[22] Filed: Dec. 31, 1980

[51] Int. Cl.[3] ..... E02B 17/00; E04H 9/02

[52] U.S. Cl. ..... 405/211; 52/167; 405/201

[58] Field of Search ..... 405/195, 211, 212, 229, 405/201; 52/167; 175/7

[56] References Cited

U.S. PATENT DOCUMENTS

| | | | |
|---|---|---|---|
| 2,035,009 | 3/1936 | Rager | 52/167 |
| 2,055,000 | 9/1936 | Bacigalupo | 52/167 |
| 3,110,464 | 11/1963 | Baratoff et al. | 243/20 |
| 3,726,986 | 4/1973 | Higaki et al. | 174/43 |
| 3,732,655 | 5/1973 | Termohlen et al. | 52/73 |
| 3,761,068 | 9/1973 | Suh | 267/136 |
| 3,796,017 | 3/1974 | Meckler | 52/292 |
| 3,977,140 | 8/1976 | Matsudaira et al. | 52/167 |
| 4,081,039 | 3/1978 | Wardlaw | 175/7 |
| 4,152,087 | 5/1979 | Zaleski-Zamenhof et al. | 405/195 |
| 4,191,495 | 3/1980 | Rivacoba et al. | 405/195 |
| 4,264,236 | 4/1981 | McConnell | 405/211 |

*Primary Examiner*—David H. Corbin

*Attorney, Agent, or Firm*—C. A. Huggett; M. G. Gilman; J. F. Powers, Jr.

[57] ABSTRACT

A support arrangement for a platform held in suspension from an offshore frame structure which provides damping between the structures in inverse proportion to the magnitude of a seismic shock. The effects of seismic shocks on the suspended platform are mitigated by providing first and second nonlinear shock absorbers coupled laterally in first and second horizontal directions between the platform and the frame structures. The first and second shock absorbers are designed to be substantially rigid to provide stiff damping for relatively low amplitude seismic forces while providing substantially softer or less rigid damping for relatively high amplitude seismic forces, such that the suspended load is able to move relatively freely in all horizontal directions when it is subjected to relatively severe seismic shocks.

4 Claims, 3 Drawing Figures

MARINE STRUCTURE HAVING A DECK OR WORK PLATFORM SUPPORTED BY ABSORBING MECHANISMS

BACKGROUND OF THE INVENTION

1. Field of the Invention

The present invention relates generally to an offshore marine platform which is designed to withstand seismic shocks. More particularly, the subject invention is directed to an arrangement wherein a marine platform is supported in suspension from an exterior frame structure resting on the sea floor, and the manner of suspension is designed to compensate for seismic shocks encountered by the marine platform.

2. Discussion of the Prior Art

Some offshore marine platforms resting on the bottom of the sea have to be designed to withstand not only stresses by winds and wave swells but also stresses caused by seismic shocks, this latter factor even being regarded as predominant in areas considered subject to strong seismic phenomena. However, the two types of disturbances proceeding from a wave swell and from a seismic shock respectively manifest themselves in frequency ranges far apart from each other. The result is that a structure which is designed to resist wave swells turns out to be too rigid to resist seismic shocks and that, on the contrary, a structure designed to resist seismic shocks is not sufficiently rigid to resist wave swells.

This has led to a concept of relieving a disturbance reaction by putting into effect a controlled decoupling system for platform structures. More precisely, it has been suggested that the structure be designed rigidly with regard to the action of swells, at the same time arranging integrating linkage parts in the structure which are designed to break following a seismic shock. These parts are specifically designed to break in such a manner as to bring into play flexible interconnecting members held in reserve and arranged to back up the temporary integrating parts.

Zaleski-Zamenhof et al. U.S. Pat. No. 4,152,087 discloses a construction arrangement for an offshore platform of the aforementioned type which provides a controlled decoupling of interconnected component sections of a marine platform structure. The offshore platform structure is designed to be less rigid under seismic shocks while maintaining sufficient overall rigidity to resist the action of wave swells. The coupling system comprises rigid interconnecting linkage parts, such as steel supports, and flexible interconnecting members, such as Neoprene supports, incorporated into the structure. The rigid linkage parts have a structural rigidity sufficient to maintain the overall rigidity of the platform, but are effective to break following a seismic shock. The flexible interconnecting members are held in reserve, and are arranged to back up the rigid intergrating parts. The flexible members have structural characteristics effective to maintain a controlled decoupling of the component sections when the steel supports deform or break.

Marine offshore structures are also relatively well known in the prior art which include a truss type of structure supported by legs extending to the sea floor, and a deck or work platform mounted on the truss structure on which drilling and other types of operations are performed. Templet types of offshore platforms are rigidly anchored to the sea floor by pilings which extend through tubular support legs of the truss structure into the underlying sea floor. When templet offshore structures are located in areas prone to seismic shocks, they must be designed to withstand not only loads imposed by winds and wave swells but also the additional loads of the seismic shocks. In structures of this kind the forces thereon from winds and wave swells are incident through the top of the truss structure, while the seismic shock loads are imposed on the structure through the base frame members thereof.

The prior art designs have often taken a brute force approach to all of the aforementioned imposed forces which has resulted in offshore structures which are relatively massive, incorporating therein tremendous amounts of steel in the truss frame members and, depending upon the design parameters, weighing anywhere from several hundreds of tons to many thousands of tons. The truss frame members are normally tubular in nature to minimize loading on the truss structure from winds and wave swells, and may typically vary from bottom leg members having a forty two inch diameter to top truss members having a diameter as small as ten inches. If the truss members at the top are positioned above expected wave swells, they may be nontubular structural members which are rolled or incorporate flanges therein. In these prior art designs, the deck platform typically rests on a support frame positioned at the top of the truss frame structure, although some recently constructed offshore drilling structures have mounted the deck platform in suspension from the top of the truss structure. An advantage of the latter approach is that the work platform may be floated into the middle of the truss frame structure, and then lifted into place by a cable hoist or hydraulic lift system.

SUMMARY OF THE INVENTION

Accordingly, it is a primary object of the present invention to provide an arrangement for supporting a load in suspension from an exterior frame structure resting on the ground in a manner to compensate for seismic shocks encountered thereby.

A further object of the subject invention is the provision of an arrangement of the aforesaid type which is designed for suspending a marine platform from an offshore truss structure.

Another object of the present invention is to provide a support arrangement for a platform held in suspension from an offshore frame structure which provides damping between the structures in inverse proportion to the magnitude of the seismic shock.

In accordance with the teachings herein, the present invention provides an arrangement for supporting a load in suspension from an exterior frame structure resting on the ground in a manner to compensate for seismic shocks encountered thereby. The effects of seismic shocks on the suspended load are mitigated by providing first and second nonlinear shock absorbers coupled laterally in first and second horizontal directions between the members, wherein the second direction is substantially orthogonal to the first direction. The first and second shock absorbers damp horizontal seismic forces generated between the suspended load and the exterior frame, and are designed to be substantially rigid to provide stiff damping for relatively low amplitude seismic forces while providing substantially softer or less rigid damping for relatively high amplitude seismic forces, such that the suspended load is able to move relatively freely in all horizontal directions when it is subjected to relatively severe seismic shocks.

The present invention was designed particularly for suspending a marine platform from an offshore frame structure resting on the sea bottom. Moreover, the first and second shock absorbers each provide damping for seismic forces which is inversely proportional to the magnitude of the encountered seismic shock. In one disclosed embodiment each nonlinear shock absorber includes a piston mounted for bidirectional movement in a cylinder in a manner to displace a fluid during movement thereof. A closed fluid loop couples both sides of the piston, and the impedance to fluid flowing in the loop is varied in a manner inversely proportional to the magnitude of the encountered seismic shock. In greater detail, the impedance is varied by a plurality of valves which are selectively opened in dependence upon the magnitude of the seismic shock.

BRIEF DESCRIPTION OF THE DRAWINGS

The foregoing objects and advantages of the present invention for a suspension system for an offshore marine platform may be more readily understood by one skilled in the art with reference being had to the following detailed description of several preferred embodiments thereof, taken in conjunction with the accompanying drawings wherein like elements are designated by identical reference numerals throughout the several drawings, and in which.

DETAILED DESCRIPTION OF THE DRAWINGS

Figure 1:
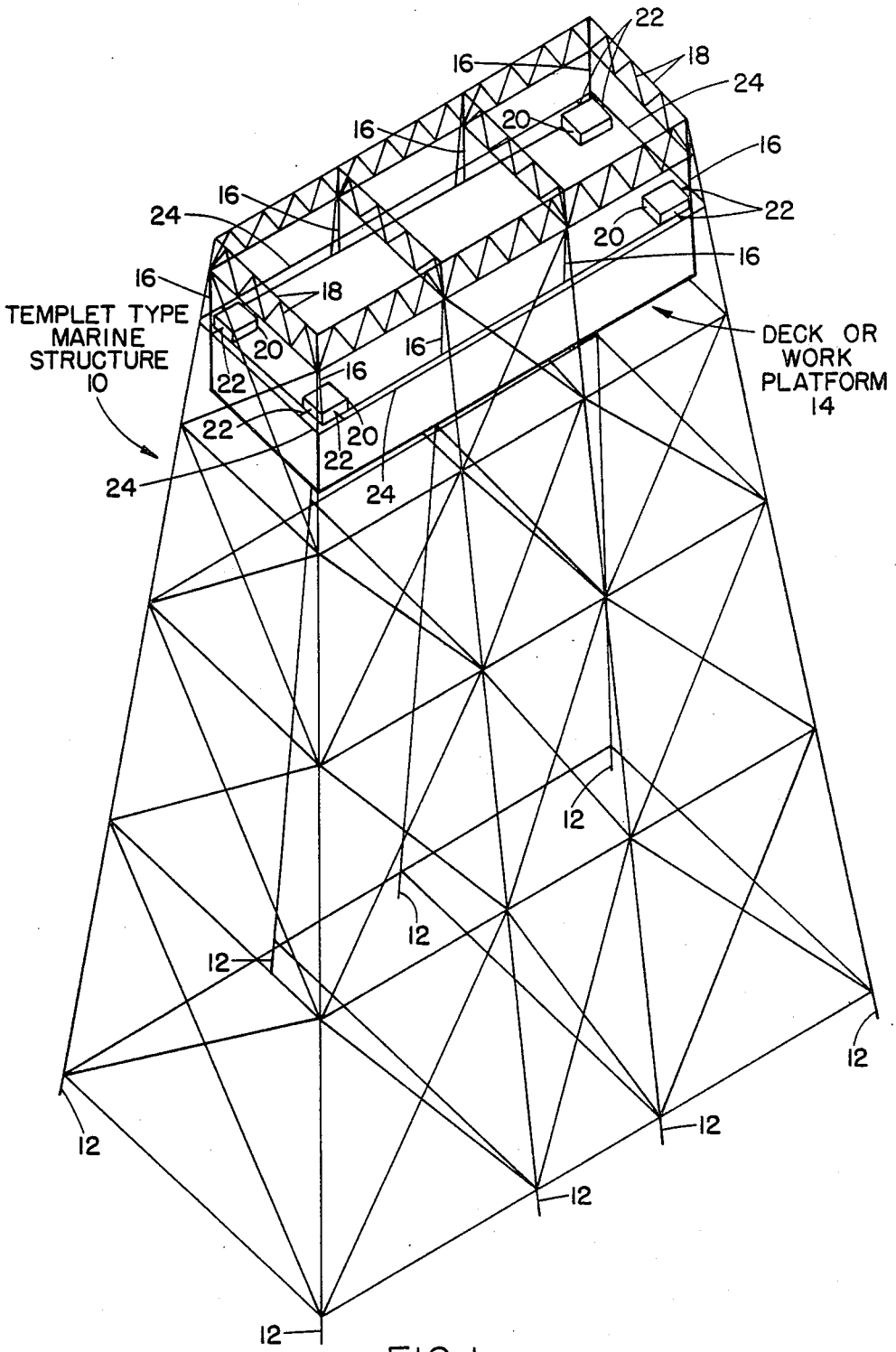
FIG. 1 is a perspective view of an exemplary embodiment of an offshore truss structure wherein the support system for a working platform suspended therefrom is constructed pursuant to the teachings of the present invention.

Referring to the drawings in detail, FIG. 1 illustrates an exemplary embodiment of the present invention wherein a templet type of structure 10 is supported by legs 12 extending to the sea bottom. Templet or jacket types of offshore platforms are rigidly anchored to the sea floor by pilings which extend through the tubular support legs 12 of the truss structure 10 into the underlying sea floor. Templet marine structures are well known in the art, and, depending upon the design parameters, weigh anywhere from several hundreds of tons to many thousands of tons. The truss frame members are normally tubular in nature to minimize loading on the truss structure from winds and wave swells, and may typically vary from bottom leg members having a forty two inch diameter to top truss members having a diameter as small as ten inches.

A deck or work platform 14, on which drilling and other types of operations are normally performed, is suspended by structural members 16 extending from the work platform 14 to a truss structure 18 at the top of the templet structure 10.

In a preferred embodiment, the structural members 16 are typically tubular members welded at both ends to the upper truss structure 18 and the platform 14. During the occurrence of seismic shock loads, the structural members 16 normally flex along their length to allow horizontal movement of the exterior frame structure 10 relative to the platform 14. This flexing of the support members 16 provides a dampening effect for relative movement between the exterior frame 10 and the platform 14 which operates in concert with damping provided by nonlinear shock absorber arrangements 20 provided at each corner of platform 14. In alternative embodiments, other types of vertical support members 16, such as flanged beams or cables, might also be incorporated into the design. However, the aforementioned dampening provided by these support elements make rigid members a preferred structural design.

An advantage of the disclosed embodiment wherein the platform 14 is supported in suspension from the top of the truss structure 10 is that the work platform may be floated into the middle of the truss frame structure, and then lifted into place by a cable hoist or hydraulic lift system. Moreover, the lifting system may be constructed as an integral part of the platform such that additional external equipment, such as derricks, are not required for assembly of the completed platform.

Figure 2:
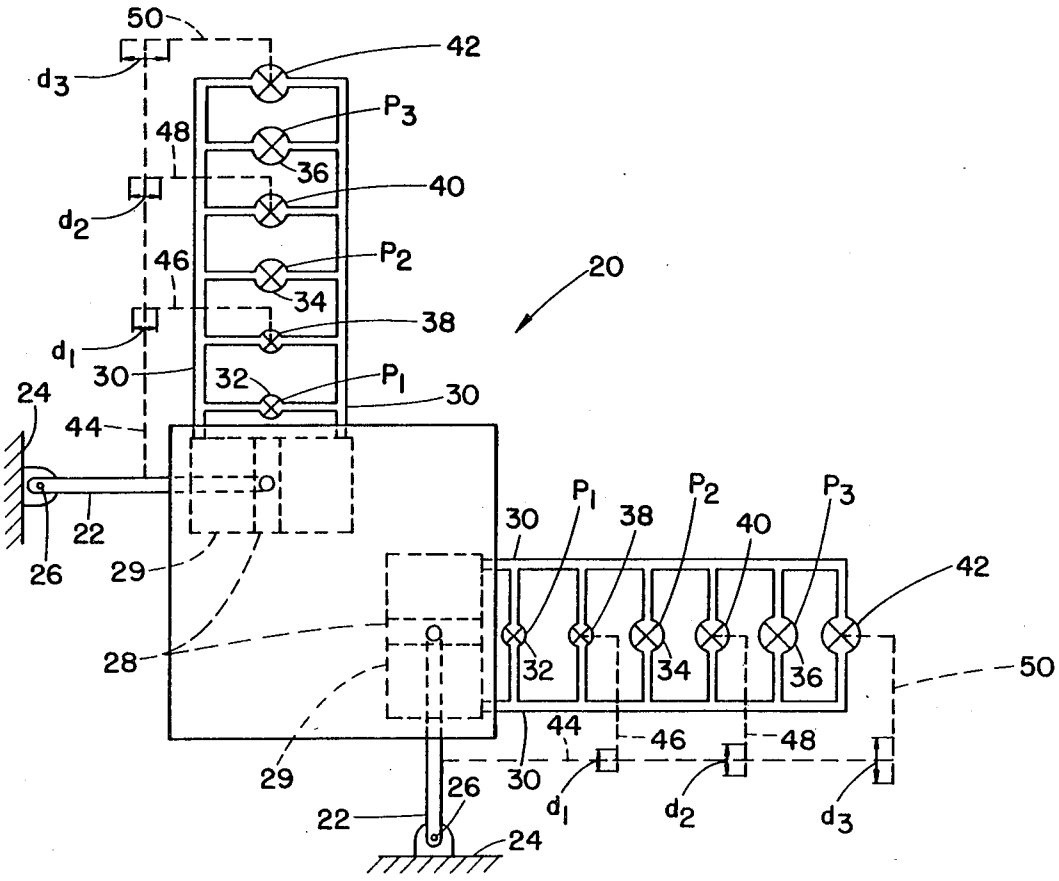
FIG. 2 illustrates further details of one of the nonlinear shock adsorbers incorporated in the suspension system shown in FIG. 1.
Figure 3:
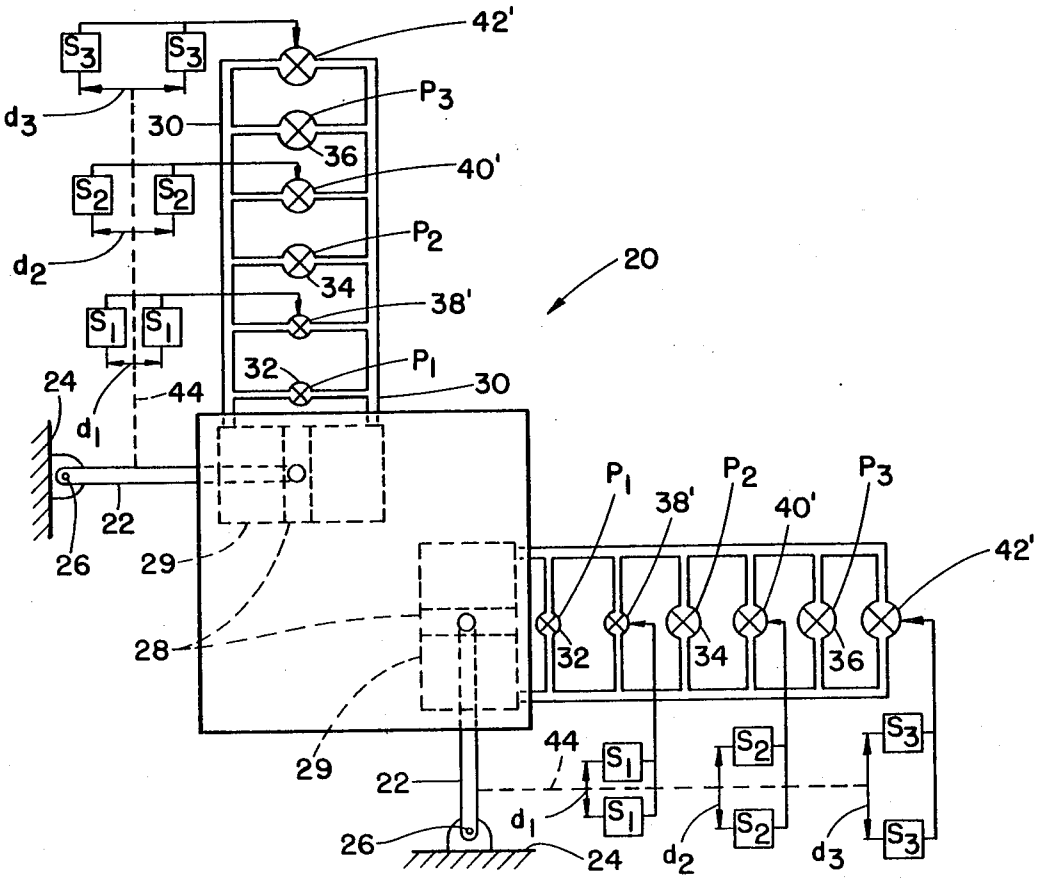
FIG. 3 is a schematic illustration of a second embodiment of a nonlinear shock absorber which may be utilized in the arrangement of FIG. 1.

Rods 22 extend horizontally from each nonlinear shock absorber 20 in two orthogonal directions to couple the shock absorber to a frame member 24 of the external truss structure 10. FIGS. 2 and 3 illustrate exemplary designs for first and second embodiments of a nonlinear shock absorber. The shock absorber 20 is rigidly attached to the platform 14, although in alternative embodiments it might be secured to the external frame structure 10 rather than the platform. The coupling rods 22 are pinned at 26 to the external frame member 24, and are coupled at their second ends to pistons 28 in cylinders 29. Each shock absorber 20 includes two orthogonally positioned cylinders 29 such that the arrangement is capable of absorbing seismic loads in all horizontal directions. Although the disclosed embodiment is designed to absorb only horizontal seismic forces, in some geographical locations vertical seismic shocks may also be a significant factor. In those instances, a third nonlinear shock absorber extending in a vertical direction may be added to provide seismic load absorption for vertically imposed seismic force components.

Each cylinder has a closed fluid loop 30 coupled to both sides of piston 28 through a plurality of control valves which include pressure responsive relief valves 32, 34 and 36 and displacement responsive valves 38, 40 and 42. The fluid loop is designed so that all of the valves are closed under normal loads imposed by winds and wave swells, such that each piston 28 is held relatively immovable by a noncompressible hydraulic fluid in its closed loop 30. This arrangement provides substantially rigid and stiff damping between the suspended deck 14 and the marine structure 10 under normal conditions.

Upon the occurrence of a relatively low order seismic shock, valves 32 and 38 are designed to open, valve 32 in response to a predetermined pressure increase to pressure $p_1$, and valve 38 in response to a predetermined incremental displacement $d_1$ between the platform 14 and the surrounding structure 10. Opening of valves 32 and/or 38 results in less rigid damping between the coupled members 10 and 14 as hydraulic fluid can now flow in closed loop 30 through valves 32 and/or 38. The mechanical connections 44, 46 which actuate valve 38 are designed such that valve 38 remains open even after passage of the seismic shock. For instance, an operating lever attached to valve 38 might be pushed or displaced by linkage 46 out of its way such that a return of linkage 46 to its initial position is not effected after passage of the seismic tremors. Valve 38 might thereafter be reset to its closed position either manually or otherwise. Pressure responsive valve 32 might be a typical pressure relief valve which either resets itself or not after the pressure in loop 30 drops below the threshold pressure $p_1$.

Upon the occurrence of a medium order seismic shock, additional valves 34 and 40 are designed to open, valve 34 in response to a predetermined pressure increase to pressure $p_2$, and valve 40 in response to a predetermined incremental displacement $d_2$ between the platform 14 and the surrounding structure 10. Pressure $p_2$ is a given order of magnitude greater than pressure $p_1$, and likewise displacement $d_2$ is a given magnitude greater than displacement $d_1$. Opening of valves 34 and 40 results in still less rigid damping between the coupled members 10 and 14 as the hydraulic fluid can now flow in closed loop 30 through valves 32, 38, 34 and 40. The mechanical connections 44, 48 which actuate valve 40 may be designed similar to those for valve 38, and valve 34 may be similar to valve 32 but have a higher opening threshold pressure $p_2$.

Upon the occurrence of a large order seismic shock, still additional valves 36 and 42 are designed to open, valve 36 in response to a predetermined pressure increase to pressure $p_3$, and valve 42 in response to a predetermined incremental displacement $d_3$ between the platform 14 and the surrounding structure 10. Pressure $p_3$ is a given order of magnitude greater than pressure $p_2$, and likewise displacement $d_3$ is a given order of magnitude above displacement $d_2$. Opening of valves 36 and 42 results in still less rigid damping between the coupled members 10 and 14 as the hydraulic fluid can now flow in closed loop 30 through valves 32, 38, 34, 40, 36 and 42. The mechanical connections 44, 50 which actuate valve 42 may be designed similar to those for valves 38 and 40, and valve 36 may be similar to valves 32 and 34 but have a higher opening threshold pressure $p_3$. With all valves open, the marine structure 10 is able to more relatively freely in a horizontal direction relative to platform 14 during a seismic shock. Depending upon the relative direction of the horizontal seismic tremor, different numbers of valves may be opened in the two closed fluid loops of FIG. 2, such that a different stiffness damping is provided in the two horizontal directions by the two loops of nonlinear shock absorber 20.

Valves 32, 34, 36, 38, 40 and 42 may all be the same size, or alternatively valves 34, 40 may be larger flow valves than valves 32, 38, and likewise valves 36, 42 may be larger flow valves than valves 34, 40. The conduits for each valve would be dimensioned accordingly. In general, the size of the cylinders, flow conduits and valves would depend upon the parameters and variables of each offshore installation.

Embodiments of the present invention could be designed having a lesser or greater number of valves, only one type of valve, either pressure responsive or displacement responsive, or other types of valves depending upon the seismic-related parameter being sensed. Moreover, although four nonlinear shock absorbers are illustrated herein, other numbers of shock absorbers might be utilized. For instance, only two shock absorbers located on diametrically opposite portions of the structure would be sufficient in some instances. Further, the piston and cylinder might be designed such that displacement of the piston in the cylinder covers and uncovers different valve ports therein in a manner similar to a two cycle internal combustion engine.

FIG. 3 illustrates a further embodiment similar in concept to that shown in FIG. 2, but wherein valves 38', 40' and 42' are electrically operated valves responsive to signals from respectively pairs of switches $S_1$, $S_2$ and $S_3$. Switches $S_1$, $S_2$ and $S_3$ are positioned relative to mechanical linkages 44 to be closed respectively by relative displacements $d_1$, $d_2$ and $d_3$. The switches $S_1$, $S_2$ and $S_3$ can be placed at any locations where it is relatively simple to detect a displacement of truss structure 10 relative to platform 14.

The present invention eliminates or substantially reduces the force necessary to accelerate the suspended deck with respect to the supporting structure.

While several embodiments and variations of a suspension system to accommodate seismic tremors have been described in detail herein, it should be apparent that the teachings and disclosure of the present invention will suggest many other embodiments and variations to those skilled in this art.

What is claimed is:

1. A marine offshore structure for compensating for seismic shocks comprising:

(a) an exterior truss structure having its base anchored to the subsurface floor;

(b) a marine deck or work platform within said truss structure;

(c) a plurality of vertical structural members interconnecting said truss structure and said deck or working platform for suspending said deck or work platform from said truss structure, said vertical structural members being flexible along their respective length to permit horizontal movement of said truss structure relative to said deck or work platform;

(d) means for mitigating the effects of seismic shocks on said deck or work platform, including at least one first nonlinear shock absorber means coupled laterally in a first horizontal direction between said deck or work platform and said truss structure for damping horizontal seismic forces in said first direction between said deck or work platform and said truss structure, said first nonlinear shock absorber means being substantially rigid to provide stiff damping of relatively low amplitude seismic forces and providing substantially less rigid damping during relatively high amplitude seismic forces; and at least one second nonlinear shock absorber means coupled laterally in a second horizontal direction, substantially orthogonal to said first direction, between said deck or work platform and said truss structure for damping horizontal seismic forces in said second direction between said deck or work platform and said truss structure, said second nonlinear shock absorber means being substantially rigid to provide stiff damping of relatively low amplitude seismic shocks and providing substantially less damping during relatively high amplitude seismic forces, whereby said deck or work platform is able to move relatively freely in horizontal directios when it is subjected to relatively severe seismic shocks.

2. A support arrangement as claimed in claim 1, said first nonlinear shock absorber means and said second nonlinear shock absorber means each providing damping for seismic forces which is inversely proportional to the magnitude of the seismic shock.

3. A support arrangement as claimed in claim 2, said first nonlinear shock absorber means and said second nonlinear shock absorber means each including a piston mounted for bidirectional movement in a cylinder in a manner to displace a fluid during movement thereof, and a closed fluid loop coupling both sides of the piston and having a means for varying the impedance to fluid flowing in said loop inversely proportional to the magnitude of the seismic shock.

4. A support arrangement as claimed in claim 3, said means for varying the impedance including a plurality of valves which are selectively opened in dependence upon the magnitude of the seismic shock.

* * * * *